US011835924B2

(12) United States Patent
Hayashi

(10) Patent No.: US 11,835,924 B2
(45) Date of Patent: Dec. 5, 2023

(54) WATCH HAVING A FIRST BARREL COMPLETE WITH A DIAMETER THAT IS LESS THAN A DIAMETER OF A SECOND BARREL COMPLETE

(71) Applicant: Seiko Epson Corporation, Toyko (JP)

(72) Inventor: Shigeyuki Hayashi, Shiojiri (JP)

(73) Assignee: SEIKO EPSON CORPORATION

( * ) Notice: Subject to any disclaimer, the term of this patent is extended or adjusted under 35 U.S.C. 154(b) by 422 days.

(21) Appl. No.: 17/158,106

(22) Filed: Jan. 26, 2021

(65) Prior Publication Data

US 2021/0232094 A1 Jul. 29, 2021

(30) Foreign Application Priority Data

Jan. 27, 2020 (JP) ..... 2020-010781

(51) Int. Cl.

| | |
|---|---|
| ***G04B 1/16*** | (2006.01) |
| ***G04B 1/12*** | (2006.01) |
| ***G04B 7/00*** | (2006.01) |
| ***G04C 3/14*** | (2006.01) |

(52) U.S. Cl.

CPC ..... *G04B 1/16* (2013.01); *G04B 1/12* (2013.01); *G04B 7/00* (2013.01); *G04C 3/14* (2013.01)

(58) Field of Classification Search

CPC ..... G04B 1/12; G04B 1/16

See application file for complete search history.

(56) References Cited

U.S. PATENT DOCUMENTS

| | | | | |
|---|---|---|---|---|
| 410,327 | A * | 9/1889 | Meylan | G04B 1/12 368/142 |
| 748,250 | A * | 12/1903 | Wortmann | G04B 5/007 185/40 K |
| 4,363,553 | A | 12/1982 | Thomi et al. | |
| 2019/0022748 | A1 * | 1/2019 | Takemori | B22F 1/065 |

FOREIGN PATENT DOCUMENTS

| | | | |
|---|---|---|---|
| CH | 152299 | A | 1/1932 |
| JP | S51-046161 | A | 4/1976 |

* cited by examiner

*Primary Examiner* — Edwin A. Leon

(74) *Attorney, Agent, or Firm* — Harness, Dickey & Pierce, P.L.C.

(57) ABSTRACT

A watch includes a first barrel complete including a first barrel arbor, a first mainspring, and a first barrel, and a second barrel complete that includes a second barrel arbor, a second mainspring, and a second barrel, is disposed side by side in a planar direction orthogonal to a shaft direction of the first barrel arbor, and receives transmission of rotation of the first barrel complete. A tooth tip circle diameter of the first barrel complete is smaller than a tooth tip circle diameter of the second barrel complete, and a thickness of the first barrel is greater than a thickness of the second barrel.

6 Claims, 10 Drawing Sheets

WATCH HAVING A FIRST BARREL COMPLETE WITH A DIAMETER THAT IS LESS THAN A DIAMETER OF A SECOND BARREL COMPLETE

The present application is based on, and claims priority from JP Application Serial Number 2020-010781, filed Jan. 27, 2020, the disclosure of which is hereby incorporated by reference herein in its entirety.

BACKGROUND

1. Technical Field

The present disclosure relates to a watch.

2. Related Art

JP-A-51-46161 discloses a watch including two mainspring boxes. In the watch, the two mainspring boxes are disposed coaxially in a stacked arrangement or disposed in the same plane.

The configuration in which the two mainspring boxes are disposed in the stacked arrangement results in a thicker watch. In the configuration in which the two mainspring boxes are disposed in the same plane, the two mainspring boxes have almost the same planar size, and thus a proportion of the mainspring boxes occupying in a movement increases and an unnecessary empty space is created around the mainspring boxes.

SUMMARY

A watch according to the present disclosure includes a first barrel complete including a first barrel arbor, a first mainspring, and a first barrel, and a second barrel complete that includes a second barrel arbor, a second mainspring, and a second barrel, is disposed side by side in a planar direction orthogonal to a shaft direction of the first barrel arbor, and receives transmission of rotation of the first barrel complete, where a tooth tip circle diameter of the first barrel complete is smaller than a tooth tip circle diameter of the second barrel complete, and a thickness of the first barrel is greater than a thickness of the second barrel.

DESCRIPTION OF EXEMPLARY EMBODIMENTS

Exemplary Embodiments

A watch 1 in one exemplary embodiment according to the present disclosure will be described below with reference to the drawings. Note that, in the description of the present exemplary embodiment, a plan view refers to a state viewed from a direction along a first barrel arbor 23 and a second barrel arbor 33 that are described later, i.e., a direction orthogonal to a dial 3, and a side view refers to a state viewed from a direction perpendicular to the first barrel arbor 23 and the second barrel arbor 33.

Figure 1:
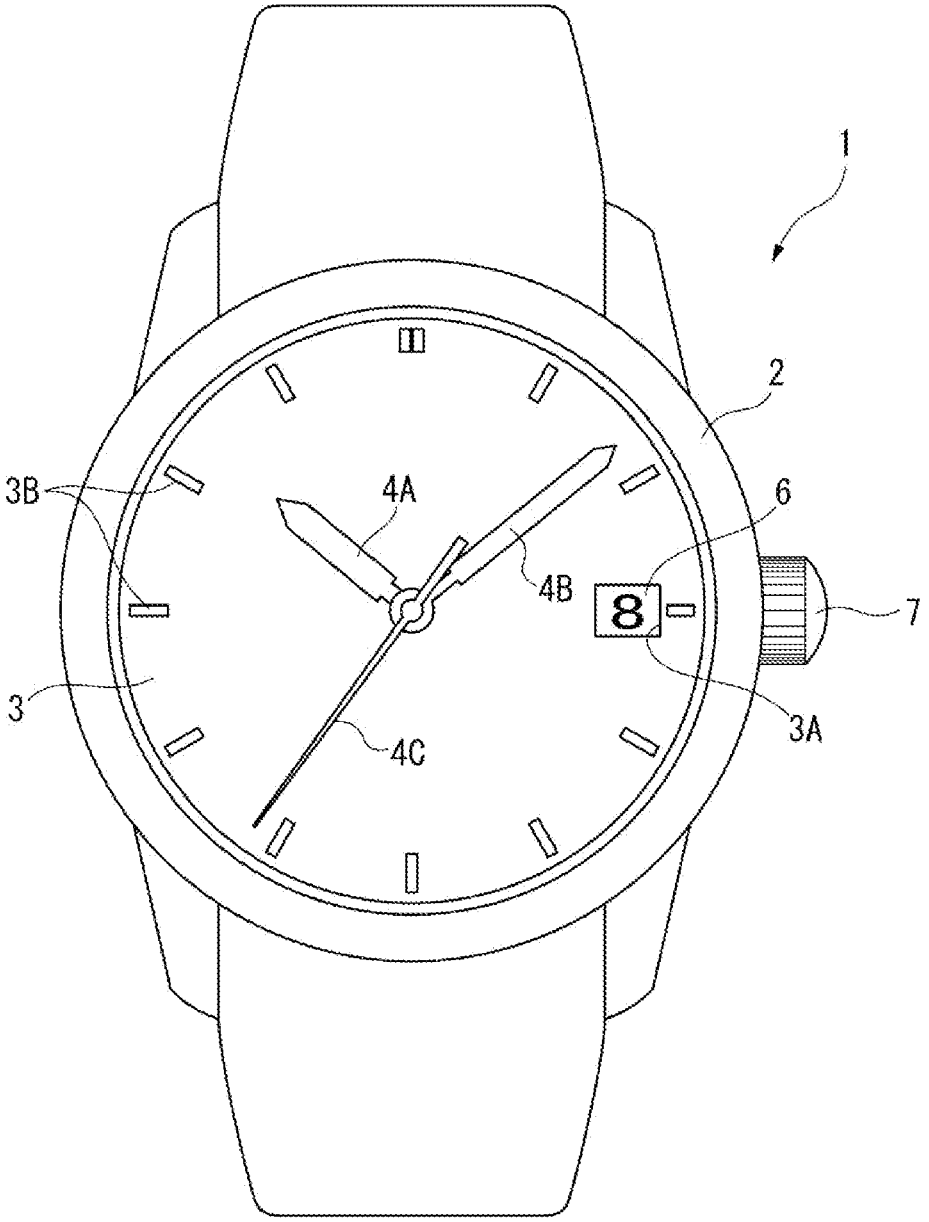
FIG. 1 is a front view illustrating a watch according to one exemplary embodiment.
Figure 2:
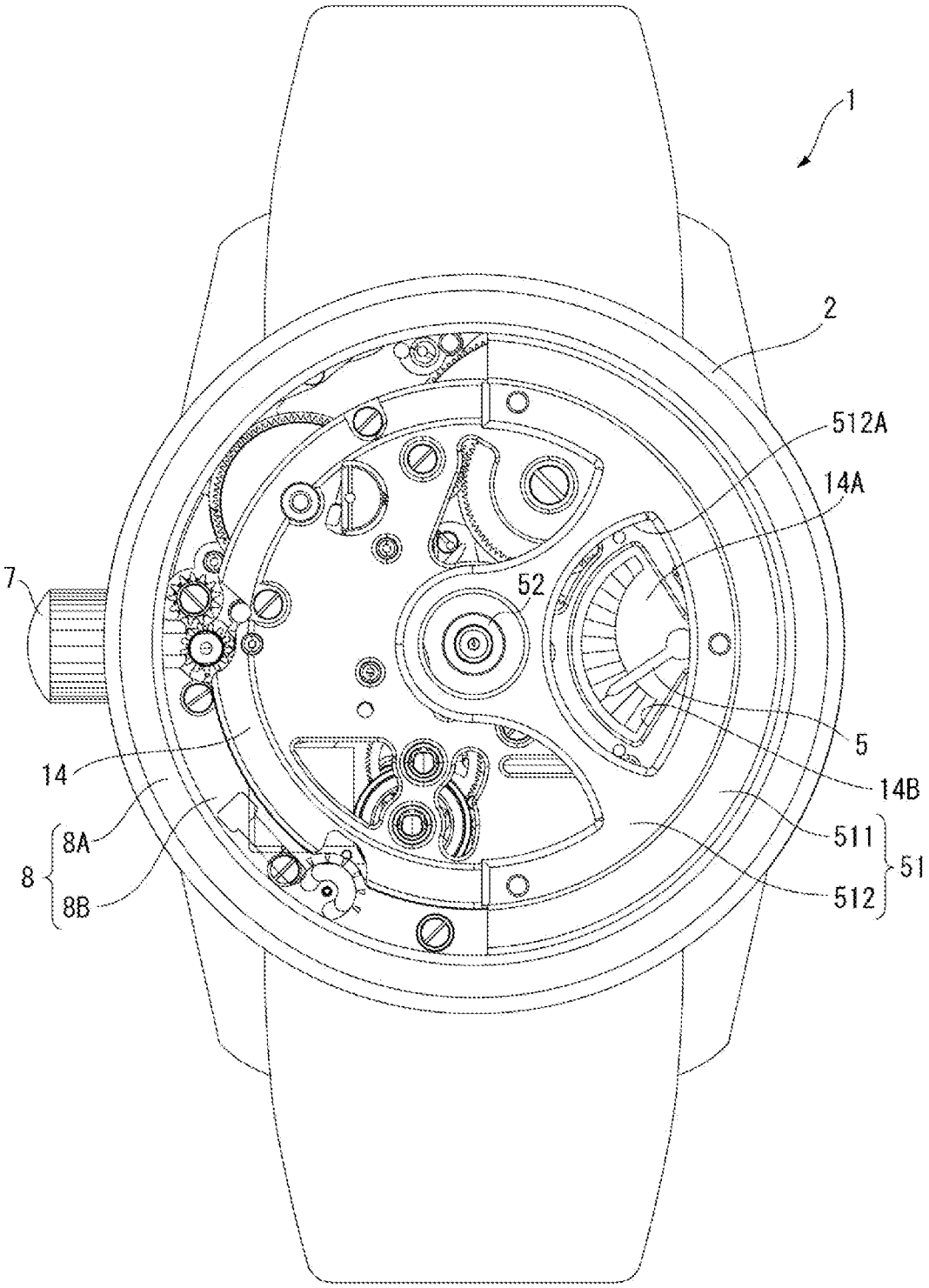
FIG. 2 is a rear view illustrating the watch.

FIG. 1 is a front view illustrating the watch 1, and FIG. 2 is a rear view illustrating the watch 1. The watch 1 according to the present exemplary embodiment is a skeleton-type watch that allows a power reserve hand 5 to be visually recognizable from a rear side of the watch 1.

The watch 1 is a wristwatch mounted on a wrist of a user, and includes an outer case 2 having a cylindrical shape with the dial 3 disposed on an inner circumferential side of the outer case 2. Of two openings of the outer case 2, the opening on the front side is blocked by a cover glass, and the opening on the rear side is blocked by a case back 8. The case back 8 is formed of a frame 8A having a ring shape and a case back glass 8B attached to the frame 8A.

The watch 1 includes a movement 10 illustrated in FIGS. 3 to 9 accommodated in the outer case 2, an hour hand 4A, a minute hand 4B, and a seconds hand 4C that indicate time information illustrated in FIG. 1, and the power reserve hand 5 indicating a remaining amount of winding up of mainsprings illustrated in FIG. 2. The dial 3 is provided with a calendar small window 3A, and a date indicator 6 is visually recognizable from the calendar small window 3A. Further, the dial 3 is provided with an hour mark 3B for indicating time. Note that the hour mark 3B is one example of a graduation according to the present disclosure.

An opening 512A is formed in a weight body 512 of an oscillating weight 51 illustrated in FIG. 2, and is configured such that the power reserve hand 5 is less visually unrecognizable due to a position of the oscillating weight 51.

A scale portion 14A having a fan shape is provided on a rear surface of a train wheel bridge 14 described later. The power reserve hand 5 indicates the scale portion 14A, and thus a remaining amount of winding up of the mainsprings can be displayed.

A crown 7 is provided on a side surface of the outer case 2. The crown 7 can be pulled and moved from a zero stage position in which the crown 7 is pushed toward the center of the watch 1 to a one stage position and a two stage position.

When the crown 7 is rotated in the zero stage position, a first mainspring 20 and a second mainspring 30 that are provided in the movement 10 can be wound up, as described later. The power reserve hand 5 moves in conjunction with the winding up of the first mainspring 20 and the second mainspring 30. The watch 1 according to the present exemplary embodiment can secure a duration of approximately 120 hours when the first mainspring 20 and the second mainspring 30 are fully wound up.

When the crown 7 is pulled to the one stage position and is rotated, a date can be adjusted by moving the date indicator 6. When the crown 7 is pulled to the two stage position, the minute hand 4C stops. When the crown 7 is rotated in the two stage position, time can be adjusted by moving the hour hand 4A and the minute hand 4B. A method for correcting the date indicator 6, the hour hand 4A, and the minute hand 4B by the crown 7 is similar to that of a known mechanical watch, and thus description thereof will be omitted.

Movement

Figure 3:
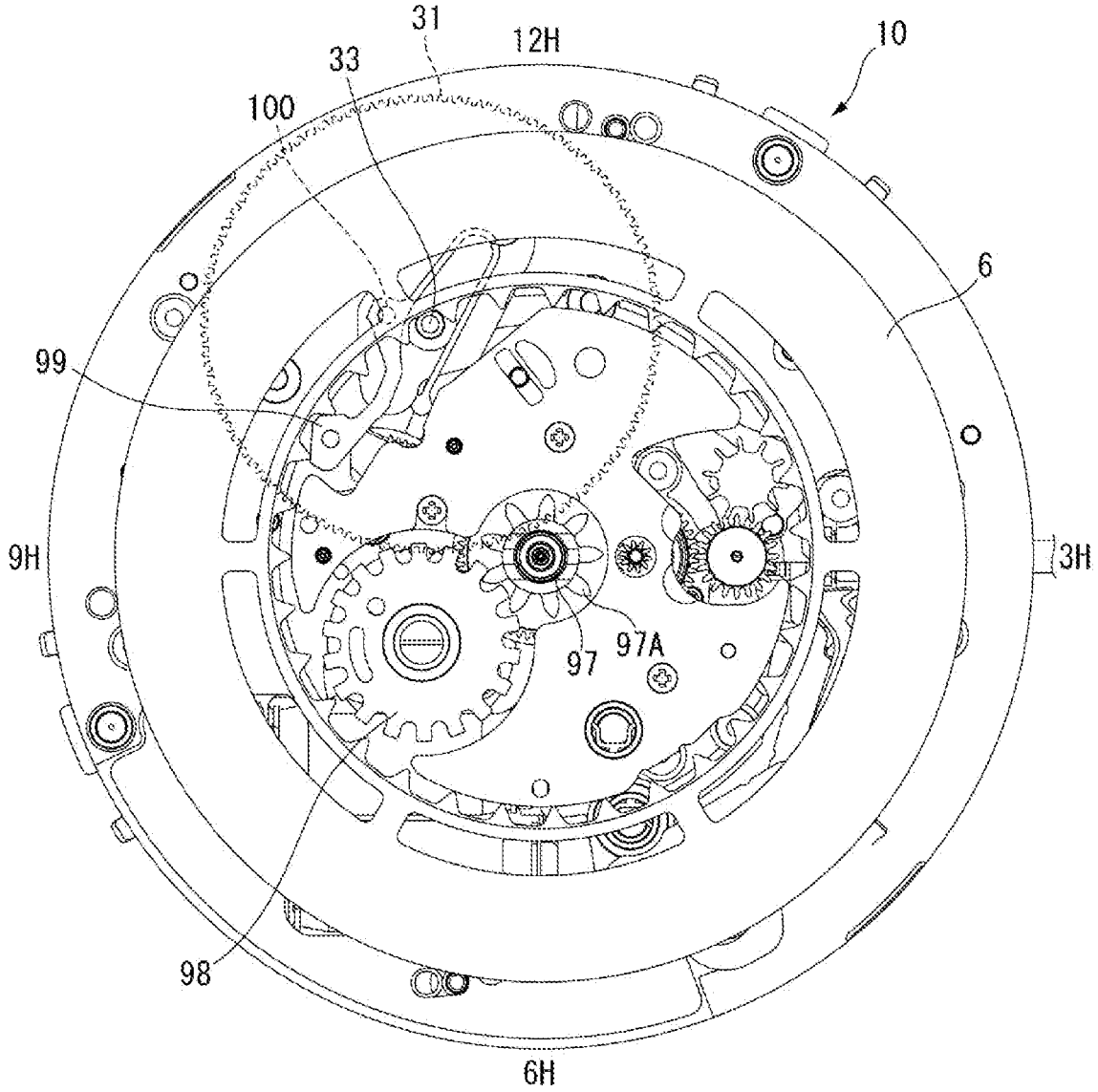
FIG. 3 is a plan view illustrating a main portion of a movement of the watch.
Figure 4:
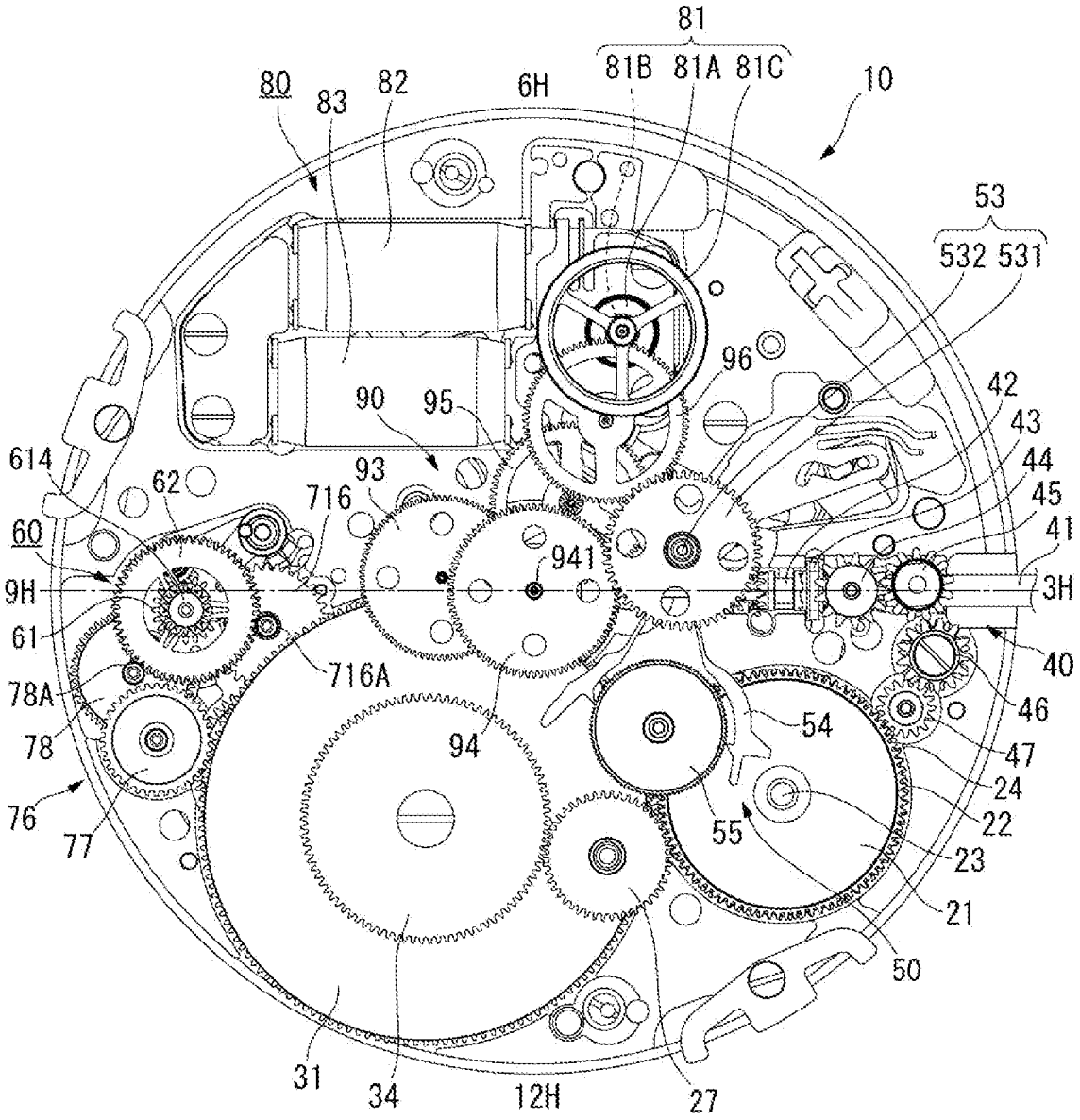
FIG. 4 is a plan view illustrating the main portion of the movement of the watch.
Figure 5:
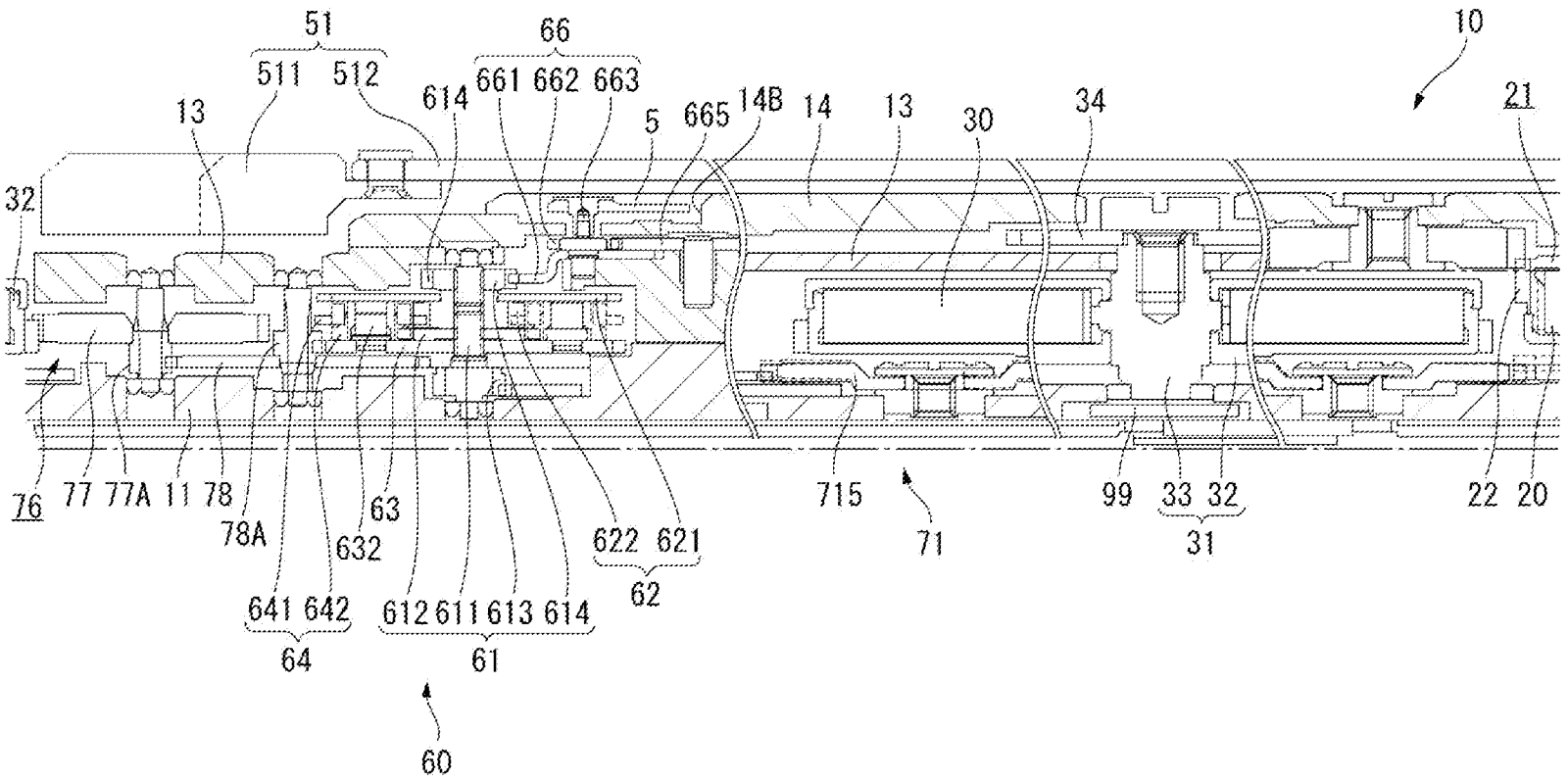
FIG. 5 is a cross-sectional view illustrating the main portion of the movement of the watch.
Figure 6:
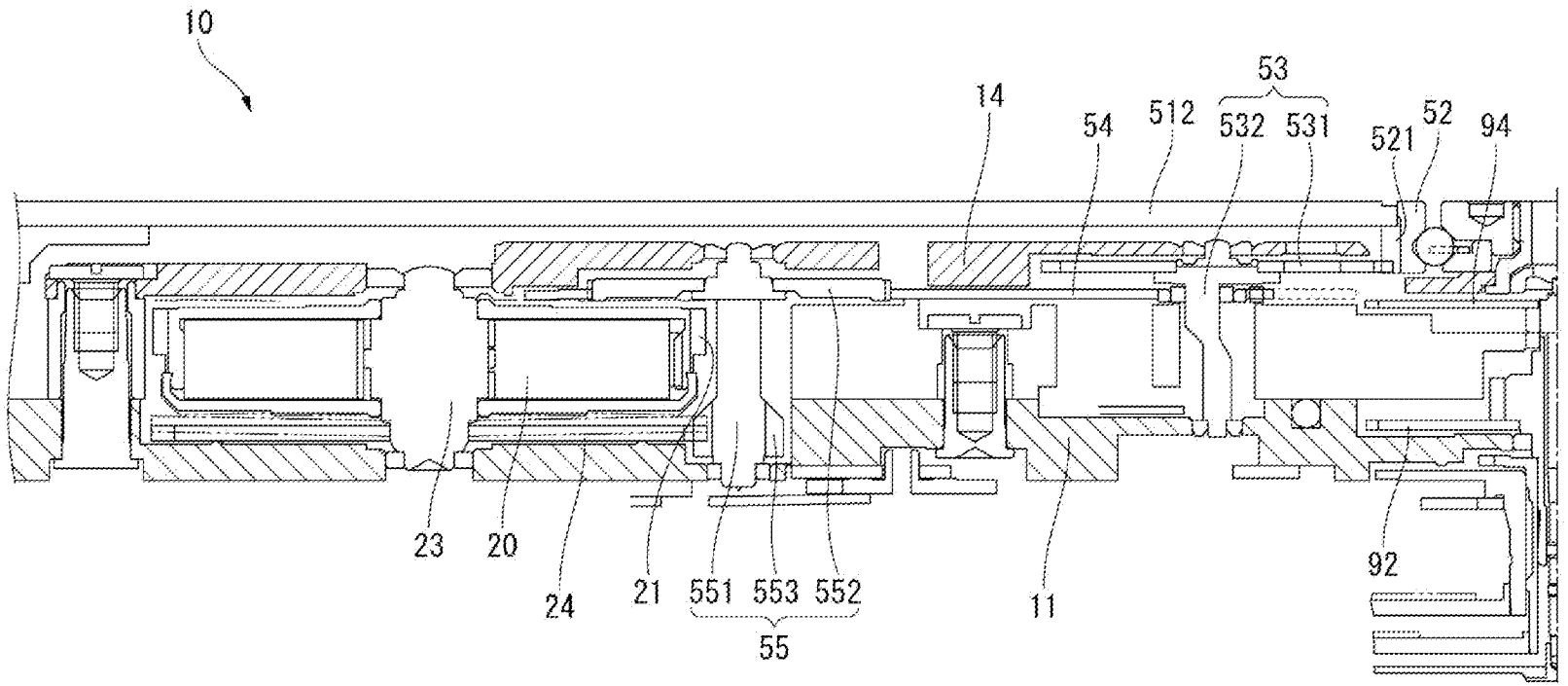
FIG. 6 is a cross-sectional view illustrating the main portion of the movement of the watch.
Figure 7:
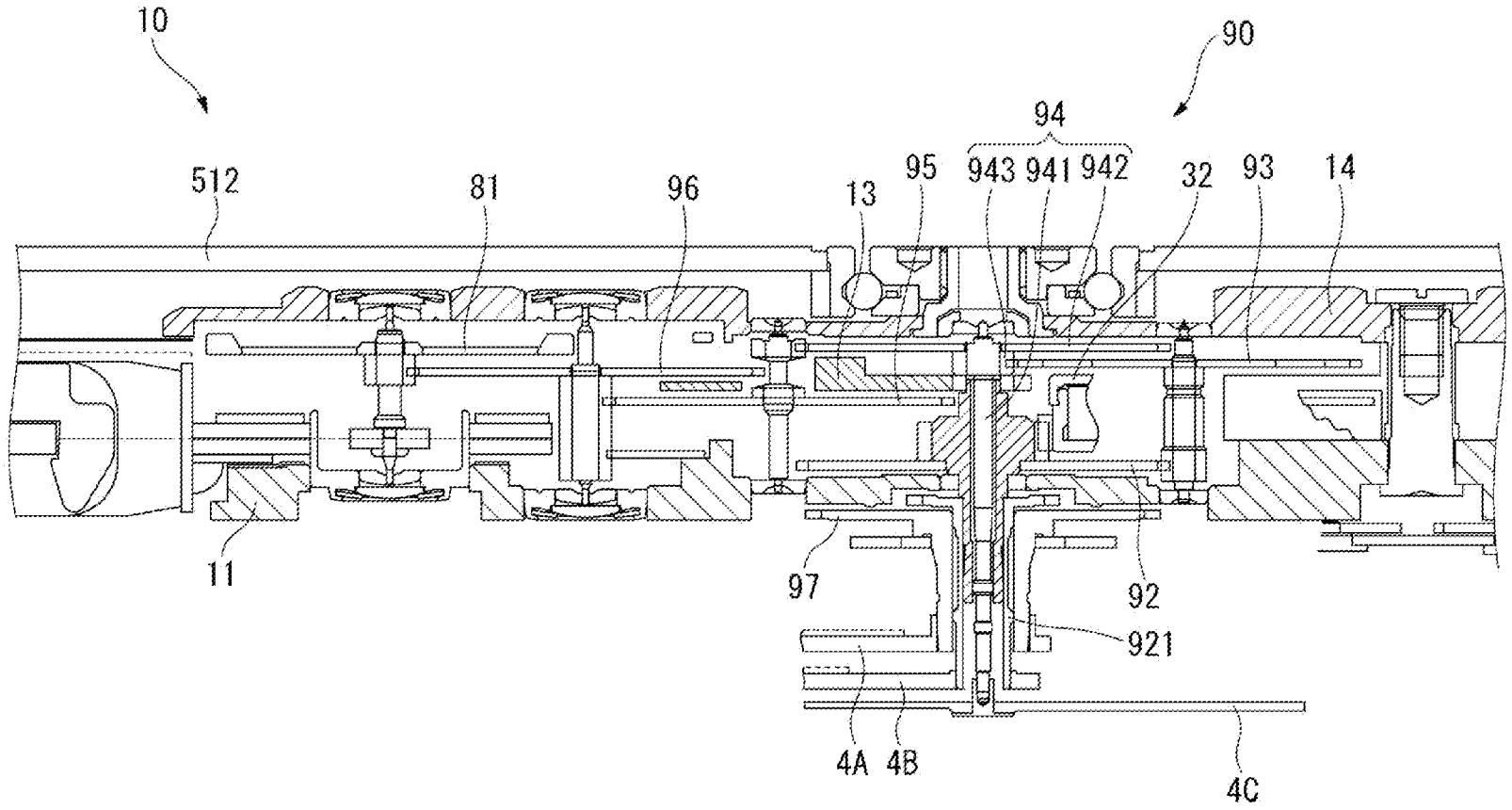
FIG. 7 is a cross-sectional view illustrating the main portion of the movement of the watch.
Figure 8:
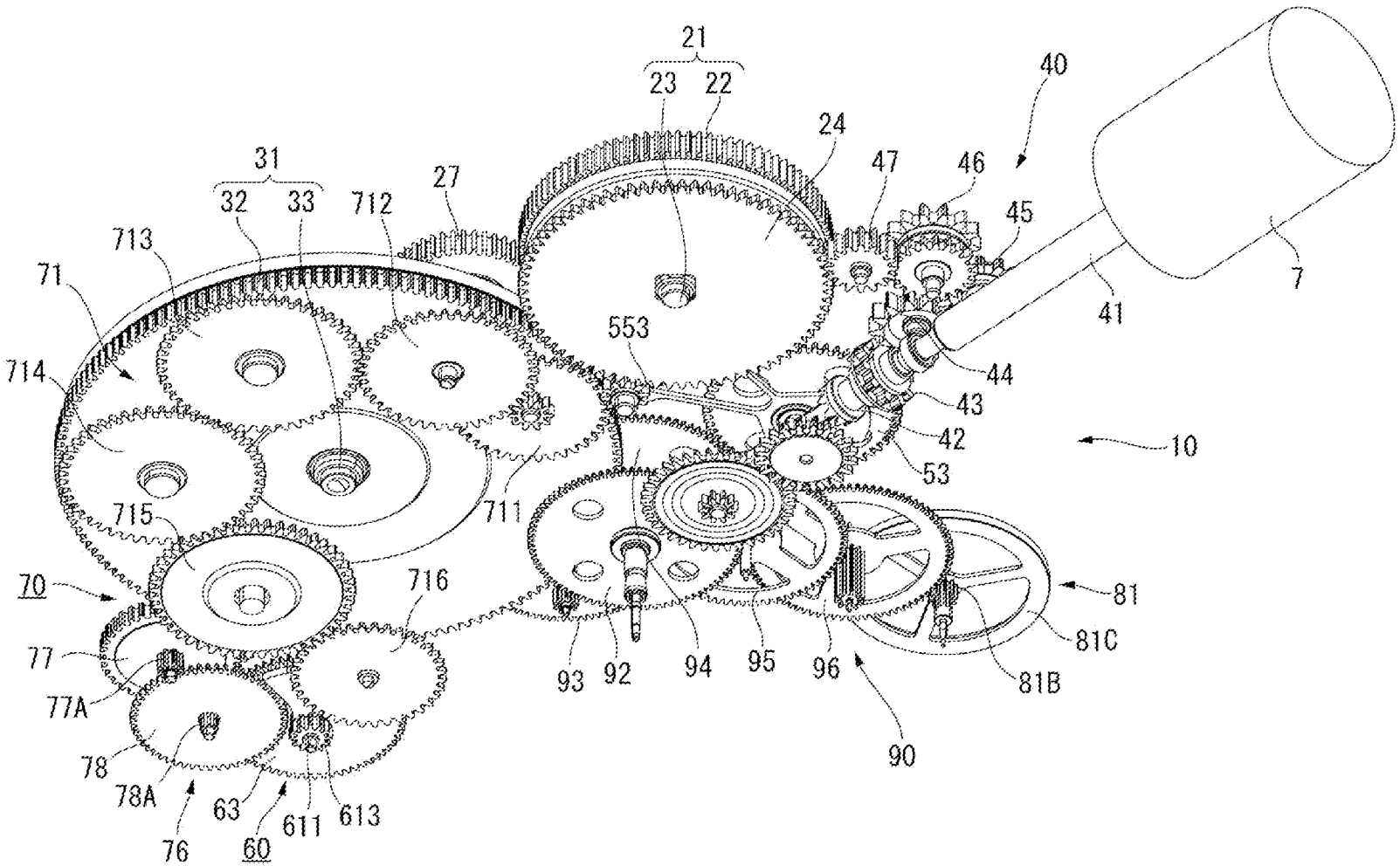
FIG. 8 is a perspective view illustrating the main portion of the movement of the watch.
Figure 9:
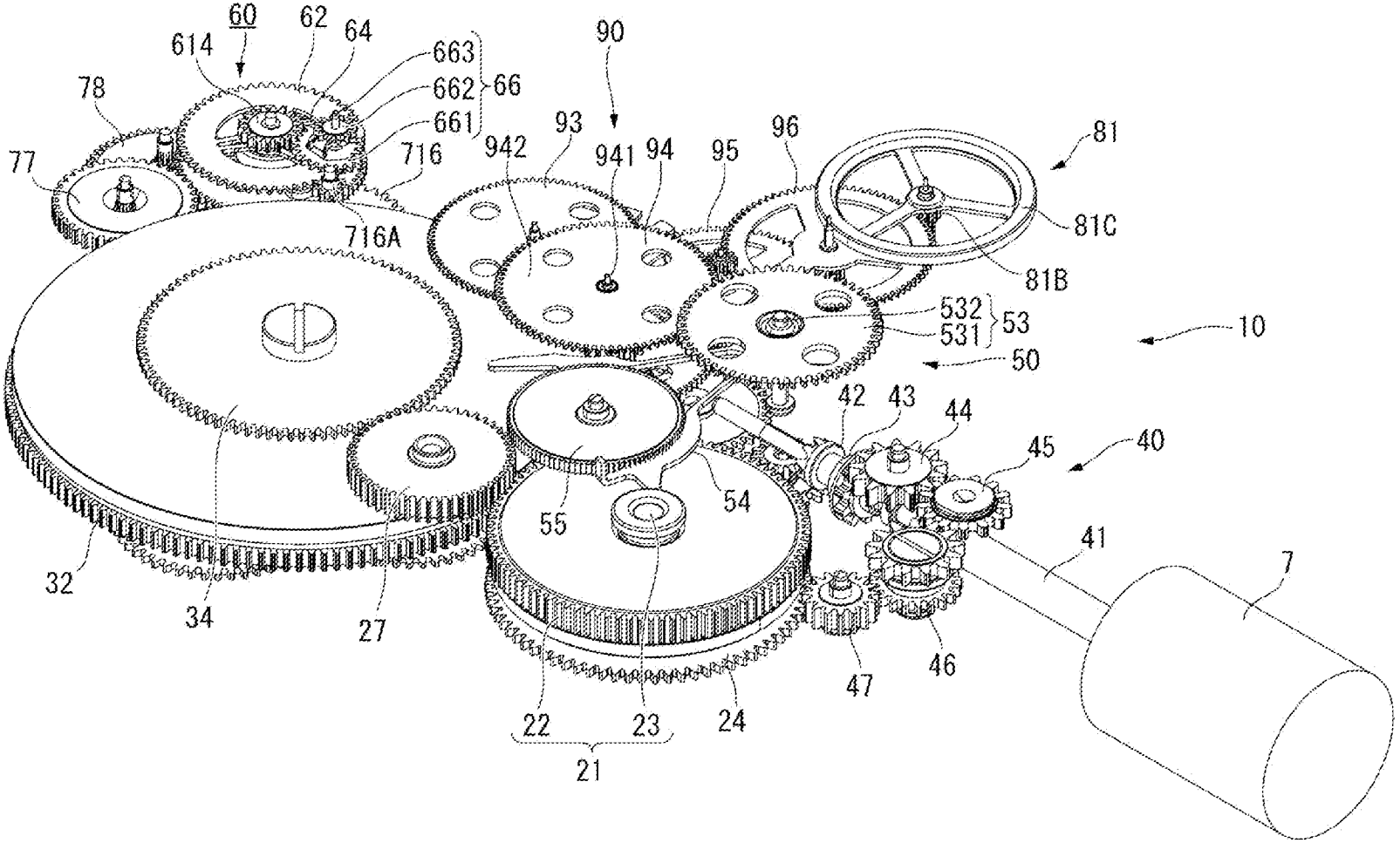
FIG. 9 is a perspective view illustrating the main portion of the movement of the watch.
Figure 10:
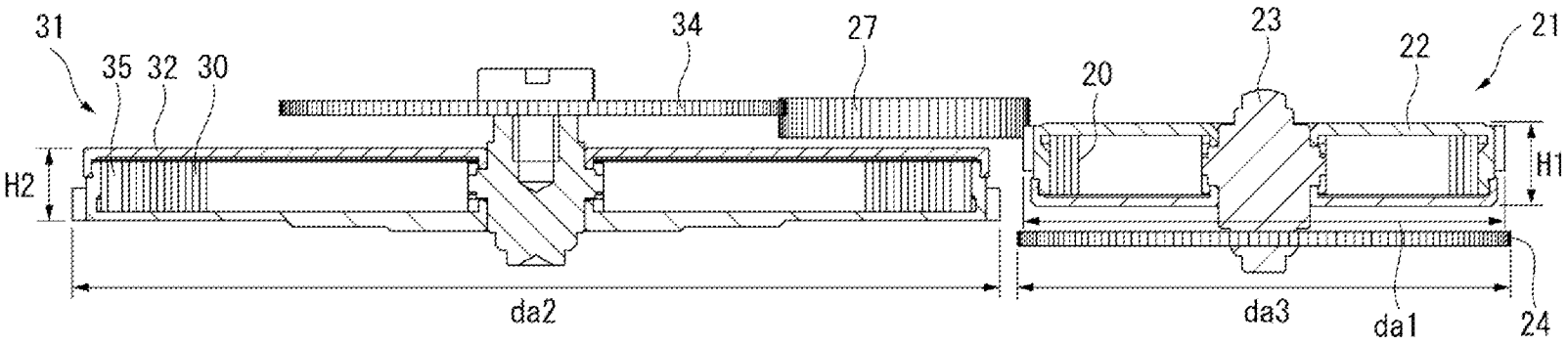
FIG. 10 is a cross-sectional view illustrating a first barrel complete and a second barrel complete of the watch.

Next, the movement 10 will be described with reference to FIGS. 3 to 10. FIG. 3 is a plan view of a main portion of the movement 10 as viewed from a dial 3 side. FIG. 4 is a plan view of the main portion of the movement 10 as viewed from a case back 8 side. FIGS. 5 to 7 are cross-sectional views of the main portion of the movement 10. FIGS. 8 and 9 are perspective views illustrating the main portion of the movement 10. FIG. 10 is a cross-sectional view illustrating a first barrel complete 21 and a second barrel complete 31 that are a drive source of the movement 10.

The movement 10 includes the first barrel complete 21 in which the first mainspring 20 is accommodated, and the second barrel complete 31 in which the second mainspring 30 is accommodated. As described later, the hour hand 4A, the minute hand 4B, and the seconds hand 4C are attached to an hour wheel 97, a cannon pinion 921, and a seconds hand axis 941 of the movement 10, respectively, and are driven by the first mainspring 20 and the second mainspring 30 of the movement 10.

As illustrated in FIGS. 5 to 7, the movement 10 includes a main plate 11, a center wheel bridge 13, and the train wheel bridge 14. As illustrated in FIG. 4, the first barrel complete 21 in which the first mainspring 20 is accommodated, the second barrel complete 31 in which the second mainspring 30 is accommodated, and a manual windup mechanism 40 and an automatic windup mechanism 50 for winding up the first mainspring 20 and the second mainspring 30 are disposed between the main plate 11 and the train wheel bridge 14. Further, a power reserve display mechanism for displaying a remaining amount of winding up of the first mainspring 20 and the second mainspring 30, a display train wheel 90 that transmits torque of the first mainspring 20 and the second mainspring 30, and a generator 80 driven by the torque transmitted via the display train wheel 90 are disposed between the main plate 11, and the central wheel bridge 13 and the train wheel bridge 14.

Here, in the present exemplary embodiment, as illustrated in FIGS. 2 and 5, a weight 511 and the train wheel bridge 14 are disposed in positions that do not overlap each other in the plan view, and are disposed so as to partially overlap each other in the side view. Thus, a thickness of the watch 1 can be reduced as compared to a case in which the weight 511 and the train wheel bridge 14 are disposed side by side in a thickness direction of the watch 1.

First Mainspring and First Barrel Complete

The first mainspring 20 is accommodated in the first barrel complete 21. Thus, the first barrel complete 21 includes the first mainspring 20, a first barrel 22, and the first barrel arbor 23. Also, as illustrated in FIG. 8, a first ratchet wheel 24 that rotates integrally with the first barrel arbor 23 is attached to the first barrel arbor 23.

Manual Windup Mechanism

As illustrated in FIGS. 4 and 8, the manual windup mechanism 40 includes a winding stem 41 to which the crown 7 is attached, a clutch wheel 42, a winding pinion 43, a crown wheel 44, a ratchet first transmission wheel 45, a ratchet second transmission wheel 46, and a ratchet third transmission wheel 47. The ratchet third transmission wheel 47 meshes with the first ratchet wheel 24.

Thus, when the user performs a rotation operation on the crown 7 in the zero stage position, the winding stem 41 and the clutch wheel 42 rotate. When the crown 7 is in the zero stage position, the clutch wheel 42 meshes with the winding pinion 43, and the rotation of the clutch wheel 42 is sequentially transmitted from the winding pinion 43 to the crown wheel 44, the ratchet first transmission wheel 45, the ratchet second transmission wheel 46, and the ratchet third transmission wheel 47. Thus, the first ratchet wheel 24 and the first barrel arbor 23 rotate, and the first mainspring 20 is wound up.

Note that the ratchet second transmission wheel 46 is a slotted screw-equipped wheel, and the first mainspring 20 can be wound up by inserting a slotted screwdriver or the like into a slotted screw. Thus, a structure in which the first mainspring 20 can be wound up when the movement 10 is assembled, and convenience is not impaired without disposing a ratchet screw is adopted.

Automatic Windup Mechanism

The automatic windup mechanism 50 includes the oscillating weight 51 illustrated in FIGS. 2 and 5, a bearing 52 illustrated in FIGS. 2 and 6, an eccentric wheel 53 illustrated in FIGS. 4 and 6 that meshes with an oscillating weight toothed gear 521 on an outer ring of the bearing 52, a pawl lever 54, and a transmission wheel 55.

The oscillating weight 51 includes the weight 511 and the weight body 512.

The bearing 52 rotatably supports the oscillating weight 51, and includes, on the outer ring, the oscillating weight toothed gear 521 that rotates integrally with the oscillating weight 51.

As illustrated in FIG. 6, the eccentric wheel 53 includes an eccentric shaft member 532 and an eccentric toothed gear 531. The eccentric shaft member 532 is supported by the main plate 11 and the train wheel bridge 14. Further, the eccentric shaft member 532 includes an eccentric shaft portion provided eccentrically from a rotary shaft.

The eccentric toothed gear 531 meshes with the oscillating weight toothed gear 521 of the bearing 52. In this way, the eccentric wheel 53 rotates in both positive and reverse directions in conjunction with the oscillating weight 51.

The pawl lever 54 is rotatably attached to the eccentric shaft portion of the eccentric shaft member 532 of the eccentric wheel 53.

When the eccentric wheel 53 rotates in conjunction with the oscillating weight 51, the pawl lever 54 attached to the eccentric wheel 53 advances and retracts in directions toward and away from the transmission wheel 55, and rotates the transmission wheel 55 in one direction.

As illustrated in FIG. 6, the transmission wheel 55 includes a transmission wheel shaft 551, a first transmission toothed gear 552, and a second transmission toothed gear 553.

The transmission wheel shaft 551 is supported by the main plate 11 and the train wheel bridge 14. The pawl lever 54 engages with the first transmission toothed gear 552, and the transmission wheel 55 rotates in one direction in conjunction with the advancing and retracting motion of the pawl lever 54. Then, the second transmission toothed gear 553 meshes with the first ratchet wheel 24. In this way, the first ratchet wheel 24 rotates in conjunction with the rotation of the transmission wheel 55. When the first ratchet wheel 24 rotates, the first barrel arbor 23 rotates integrally with the first ratchet wheel 24, and the first mainspring 20 is wound up.

Therefore, the watch 1 according to the present exemplary embodiment can wind up the first mainspring 20 by both of manual winding up by operating the crown 7 and automatic winding up by rotating the oscillating weight 51. The transmission wheel 55 is a windup wheel that meshes with the first ratchet wheel 24 in the automatic windup mechanism 50.

Second Mainspring and Second Barrel Complete

As illustrated in FIGS. 4 and 5, the second mainspring 30 is accommodated in the second barrel complete 31. The second barrel complete 31 includes a second barrel 32 and the second barrel arbor 33. The second barrel arbor 33 is rotatable integrally with a second ratchet wheel 34.

The second mainspring 30 is wound up by the first mainspring 20. In other words, when the first mainspring 20 is wound up and the torque that can wind up the second mainspring 30 is accumulated, the first barrel 22 of the first barrel complete 21 rotates. The first barrel 22 meshes with the second ratchet wheel 34 of the second barrel complete 31 via a barrel intermediate wheel 27. When the first barrel 22 rotates, the second ratchet wheel 34 and the second barrel arbor 33 rotate, and the second mainspring 30 is wound up.

Therefore, in the watch 1 according to the present exemplary embodiment, the first mainspring 20 and the second mainspring 30 can be wound up by any of the manual windup mechanism 40 and the automatic windup mechanism 50. Note that only one of the manual windup mechanism 40 and the automatic windup mechanism 50 may be provided for the watch 1.

Further, the first barrel complete 21 and the second barrel complete 31 are disposed in one of two regions acquired by virtually dividing the main plate 11 into two in a shaft direction of the winding stem 41. The shaft direction of the winding stem 41 is a direction that connects the hour marks 3B at three o'clock and nine o'clock of the dial 3, and the main plate 11 is virtually divided into two regions on the 12 o'clock side and the six o'clock side. Note that, in the present exemplary embodiment, description is given on the assumption that, of the two regions, the region on the six o'clock side is a first region, and the region on the 12 o'clock side is a second region.

Here, as illustrated in FIG. 4, in the watch 1 according to the present exemplary embodiment, the first barrel complete 21 and the second barrel complete 31 are disposed in positions that do not overlap each other in the plan view in the region on the 12 o'clock side, i.e., the second region. Note that a configuration is not limited to the configuration described above, and, for example, the first barrel complete 21 and the second barrel complete 31 may be disposed in the first region.

Power Reserve Display Mechanism

The watch 1 includes the power reserve display mechanism for displaying a remaining amount of winding up of the first mainspring 20 and the second mainspring 30 that are a drive source. The power reserve display mechanism includes a planetary toothed gear mechanism 60, a power reserve train wheel 70, the fan-shaped scale portion 14A disposed on the train wheel bridge 14 illustrated in FIG. 2, and the power reserve hand 5. A substantially belt-shaped scale indicated by the power reserve hand 5 is written on the scale portion 14A. Note that a duration of the watch 1 can be estimated from a remaining amount of winding up of the first mainspring 20 and the second mainspring 30 that are a drive source, and thus the duration can be indicated by the power reserve hand 5 when a number indicating the duration is printed on the scale portion 14A.

As illustrated in FIG. 8, the power reserve train wheel 70 includes a windup display train wheel 71 and a rewind display train wheel 76.

The windup display train wheel 71 includes a first planetary transmission wheel 711, a second planetary transmission wheel 712, a third planetary transmission wheel 713, a fourth planetary transmission wheel 714, a fifth planetary transmission wheel 715, and a sixth planetary transmission wheel 716. The first planetary transmission wheel 711 meshes with the second transmission toothed gear 553. When the first ratchet wheel 24 is rotated by the manual windup mechanism 40 or the automatic windup mechanism 50, the first ratchet wheel 24, the second transmission toothed gear 553, the first planetary transmission wheel 711, the second planetary transmission wheel 712, the third planetary transmission wheel 713, the fourth planetary transmission wheel 714, the fifth planetary transmission wheel 715, and the sixth planetary transmission wheel 716 rotate in conjunction. As illustrated in FIG. 4, a pinion 716A that meshes with the planetary toothed gear mechanism 60 is provided on a rotary shaft of the sixth planetary transmission wheel 716.

The first planetary transmission wheel 711, the second planetary transmission wheel 712, the third planetary transmission wheel 713, the fourth planetary transmission wheel 714, and the fifth planetary transmission wheel 715 are disposed in positions that overlap the second barrel complete 31 in the plan view. Further, the first planetary transmission wheel 711 to the fifth planetary transmission wheel 715 are disposed along a circumference of the second barrel arbor 33 of the second barrel complete 31, and are disposed in positions that do not overlap the second barrel arbor 33 in the plan view.

As illustrated in FIGS. 4 and 8, the rewind display train wheel 76 includes a seventh planetary transmission wheel 77 and an eighth planetary transmission wheel 78. The seventh planetary transmission wheel 77 includes a pinion 77A that meshes with the eighth planetary transmission wheel 78, and the eighth planetary transmission wheel 78 includes a pinion 78A that meshes with the planetary toothed gear mechanism 60. The seventh planetary transmission wheel 77 meshes with the second barrel 32. When the second barrel 32 rotates, the seventh planetary transmission wheel 77 and the eighth planetary transmission wheel 78 rotate in conjunction.

The seventh planetary transmission wheel 77 and the eighth planetary transmission wheel 78 are rotatably supported by the main plate 11 and the center wheel bridge 13.

As illustrated in FIGS. 4, 5, and 8, the planetary toothed gear mechanism 60 includes a first solar wheel 61, a second solar wheel 62, a planetary intermediate wheel 63, and a planetary wheel 64 rotatably supported by the planetary intermediate wheel 63.

As illustrated in FIG. 5, the first solar wheel 61 includes a display arbor 611 rotatably supported by the main plate 11 and the like, and a first solar toothed gear 612 fixed to the display arbor 611. A first pinion 613 is integrally formed on a first end portion of the display arbor 611 on the dial 3 side. A second pinion 614 is attached to a second end portion of the display arbor 611 on the case back side. The first pinion 613 and the second pinion 614 rotate integrally with the display arbor 611 and the first solar toothed gear 612.

As illustrated in FIG. 5, a winding wheel 66 includes a first toothed gear 661, a second toothed gear 662, and a shaft 663. The first toothed gear 661 is a toothed gear that is formed in a substantially semi-circular planar shape and meshes with the second pinion 614. The second toothed gear 662 is a toothed gear that meshes with a toothed gear 665 supported by the center wheel bridge 13. The toothed gear 665 is provided for filling gear-to-gear backlash of the winding wheel 66 and the second pinion 614. A side surface of the toothed gear 665 is biased with a spring (not illustrated) that provides force in an unwinding direction of the second mainspring 30, and the winding wheel 66 is returned in the unwinding direction of the second mainspring 30 via the toothed gear 665. With this configuration, an instruction variation of the power reserve hand 5 can be reduced and suppressed. Note that a configuration without providing the spring for filling the backlash described above may be adopted. Note that the toothed gear 665 is not illustrated in FIG. 4.

Here, in the present exemplary embodiment, as illustrated in FIG. 5, a part of the center wheel bridge 13 that supports the winding wheel 66 is disposed between the weight 511 and the main plate 11. In other words, the center wheel bridge 13 is disposed such that a part thereof overlaps the weight 511 in the plan view. In this way, the seventh planetary transmission wheel 77, the eighth planetary transmission wheel 78, and the like of the rewind display train wheel 76 can be disposed in the space of the weight 511 on the main plate 11 side, and supported by the main plate 11 and the central wheel bridge 13. Thus, in the present exemplary embodiment, the space inside the outer case 2 can be effectively utilized and the watch 1 can be reduced in size as compared to a case in which the weight 511 and the central wheel bridge 13 are disposed so as not to overlap each other in the plan view.

The power reserve hand 5 is attached to the shaft 663 of the winding wheel 66. Therefore, the winding wheel 66 is driven by the second pinion 614, and the power reserve hand 5 is configured to rotate in conjunction with the rotation of the first solar wheel 61.

Here, in the present exemplary embodiment, as illustrated in FIGS. 2 and 5, the power reserve hand 5 is disposed in a recessed portion 14B formed in the train wheel bridge 14, is disposed in a position that does not overlap the weight 511 in the plan view, and is disposed in a position that overlaps the train wheel bridge 14 in the side view. In this way, even when the weight 511 and the power reserve hand 5 are not disposed side by side in the thickness direction of the watch 1, interference between the weight 511 and the power reserve hand 5 can be prevented.

The second solar wheel 62 includes a second solar toothed gear 621 and a second solar pinion 622 fixed to the second solar toothed gear 621. The second solar pinion 622 is rotatably supported by the display arbor 611, and thus the second solar wheel 62 is rotatably disposed coaxially with the first solar wheel 61.

The planetary intermediate wheel 63 is rotatably supported by the display arbor 611, and is coaxial with the first solar wheel 61 and the second solar wheel 62. On an outer circumference of the planetary intermediate wheel 63, teeth that mesh with a pinion 78A of the eighth planetary transmission wheel 78 are formed. Further, a rotary shaft 632 having a pin shape is fixed in a position eccentric with respect to a rotary shaft of the planetary intermediate wheel 63.

The planetary wheel 64 includes a planetary toothed gear 641 and a planetary pinion 642 integrally fixed to the planetary toothed gear 641, and is rotatably supported by the rotary shaft 632 of the planetary intermediate wheel 63.

The planetary toothed gear 641 meshes with the second solar pinion 622, and the planetary pinion 642 meshes with the first solar toothed gear 612.

Operation of Power Reserve Display Mechanism

In such a power reserve display mechanism, an operation when the first mainspring 20 and the second mainspring 30 are wound up and rewound will be described.

When the first ratchet wheel 24 is rotated by the manual windup mechanism 40 and the automatic windup mechanism 50, the first barrel arbor 23 rotates and the first mainspring 20 is wound up. Further, as the first barrel arbor 23 rotates, the first planetary transmission wheel 711, the second planetary transmission wheel 712, the third planetary transmission wheel 713, the fourth planet transmission wheel 714, the fifth planetary transmission wheel 715, and the sixth planetary transmission wheel 716 of the windup display train wheel 71 rotate, and the torque is transmitted to the second solar wheel 62, the planetary wheel 64, and the first solar wheel 61. Here, when the first mainspring 20 is wound up and until the second mainspring 30 is fully wound up by the first mainspring 20, the second barrel 32 of the second barrel complete 31 slowly rotates and is almost in a stop state. Thus, the seventh planetary transmission wheel 77 and the eighth planetary transmission wheel 78 of the rewind display train wheel 76 are in a stop state, and the planetary intermediate wheel 63 that meshes with the pinion 78A of the eighth planetary transmission wheel 78 is also in a stop state. For this reason, the planetary wheel 64 supported by the rotary shaft 632 of the planetary intermediate wheel 63 rotates in the place, i.e., rotates to rotate the first solar wheel 61 and the display arbor 611 in a first direction. When the first solar wheel 61 and the display arbor 611 rotate in the first direction, the winding wheel 66 rotates via the second pinion 614, and the power reserve hand 5 rotates in a counterclockwise direction, i.e., a direction in which a remaining amount of winding up of mainsprings displayed by indicating the graduation of the scale portion 14A increases.

Further, when the first mainspring 20 and the second mainspring 30 are rewound, the first ratchet wheel 24 and the windup display train wheel 71 are stopped, and thus the second solar wheel 62 is also stopped. Then, when the second barrel 32 is rotated by rewinding of the second mainspring 30, the torque is transmitted to the planetary intermediate wheel 63 via the seventh planetary transmission wheel 77 and the eighth planetary transmission wheel 78 of the rewind display train wheel 76. When the planetary intermediate wheel 63 rotates, the second solar pinion 622 that meshes with the planetary toothed gear 641 of the planetary wheel 64 is stopped, and thus the planetary wheel 64 revolves around the second solar pinion 622 while rotating. In this way, the first solar toothed gear 612 that meshes with the planetary wheel 64 rotates in a second direction that is a reverse direction to the direction during the windup operation of the first mainspring 20 and the second mainspring 30. When the first solar toothed gear 612 rotates in the second direction, the display arbor 611 also rotates in the second direction, the rotation is transmitted to the winding wheel 66 via the second pinion 614, and the power reserve hand 5 rotates in a clockwise direction that is a reverse direction to the direction during the windup operation.

Generator

As illustrated in FIG. 4, the generator 80 includes a rotor 81 and coil blocks 82 and 83. The rotor 81 includes a rotor magnet 81A, a rotor pinion 81B, and a rotor inertial disk 81C. The rotor inertial disk 81C reduces a fluctuation in rotation speed of the rotor 81 with respect to a drive torque fluctuation from the second barrel 32. The coil blocks 82 and 83 are constituted by winding a coil on each core.

Therefore, when the rotor 81 rotates due to the torque from the outside, the generator 80 can generate induced power by the coil blocks 82 and 83, and output and supply electrical energy to an IC and the like. Further, a brake can be applied to the rotor 81 by causing the coil to short, and a rotation period of the rotor 81 can be adjusted to be constant by controlling a brake force.

In this way, the watch 1 according to the present exemplary embodiment is configured as an electronically controlled mechanical watch including the generator 80 that generates induced power, outputs electrical energy, and is also used as a speed governing mechanism.

Note that, in the present exemplary embodiment, when the main plate 11 is divided into two regions on the 12 o'clock side and the six o'clock side, the generator 80 is disposed in the region on the six o'clock side, i.e., the first region different from the second region on the 12 o'clock side in which the first barrel complete 21 and the second barrel complete 31 are disposed.

Display Train Wheel

Next, the display train wheel 90 that drives the hour hand 4A, the minute hand 4B, and the seconds hand 4C by mechanical energy from the first mainspring 20 and the second mainspring 30 will be described.

As illustrated in FIGS. 4, 7, and 8, the display train wheel 90 includes a center wheel and pinion 92, a third wheel and pinion 93, a fourth wheel and pinion 94, a fifth wheel and pinion 95, and a sixth wheel and pinion 96. After being transmitted to the center wheel and pinion 92, the rotation of the second barrel 32 sequentially increases in speed by the third wheel and pinion 93, the fourth wheel and pinion 94, the fifth wheel and pinion 95, and the sixth wheel and pinion 96, and is transmitted to the rotor 81.

As illustrated in FIG. 7, the minute hand 4B is fixed to the center wheel and pinion 92 via the cannon pinion 921.

The fourth wheel and pinion 94 includes the seconds hand shaft 941 to which the seconds hand 4C is fixed, a fourth toothed gear 942 that meshes with the fifth wheel and pinion 95, and a fourth pinion 943 that meshes with the third wheel and pinion 93. In the present exemplary embodiment, the seconds hand shaft 941 of the fourth wheel and pinion 94 is supported by the train wheel bridge 14 and the main plate 11 via the cannon pinion 921. Note that the fourth wheel and pinion 94 is one example of a seconds wheel and pinion according to the present disclosure.

The hour wheel 97 is coupled to the cannon pinion 921 via a minute wheel (not illustrated), and the hour hand 4A is fixed to the hour wheel 97.

A date indicator driving intermediate wheel 97A is attached to the hour wheel 97, and a date indicator driving finger that rotates the date indicator 6 is attached to a date indicator driving wheel 98 rotated by the date indicator driving intermediate wheel 97A.

Further, a date jumper 99 that holds backlash of the date indicator 6 engages with an inner tooth of the date indicator 6. In the present exemplary embodiment, the date jumper 99 is swingably attached by a shaft member 100 attached to the main plate 11.

In the watch 1 described above, an AC output from the generator 80 is boosted and rectified through a rectifier circuit formed of boost rectification, full-wave rectification, half-wave rectification, transistor rectification, and the like, and is charged to a smoothing capacitor, and a rotation control device (not illustrated) that controls a rotation period of the generator 80 is operated by power from the capacitor. Note that the rotation control device is formed of an integrated circuit including an oscillator circuit, a frequency circuit, a rotation detection circuit, a rotation speed comparison circuit, an electromagnetic brake control means, and the like, and a crystal oscillator is used in the oscillator circuit.

Arrangement of Fourth Wheel and Pinion and Eccentric Wheel

As illustrated in FIG. 4, in the present exemplary embodiment, the seconds hand shaft 941 of the fourth wheel and pinion 94 and the eccentric shaft member 532 of the eccentric wheel 53 are disposed in positions that do not overlap each other in the plan view. Furthermore, as described above, the eccentric shaft member 532 and the transmission wheel shaft 551 of the transmission wheel 55 are supported by the main plate 11 and the train wheel bridge 14, as illustrated in FIG. 6. Then, as illustrated in FIG. 7, the seconds hand shaft 941 is supported by the train wheel bridge 14 and the main plate 11 via the cannon pinion 921. In other words, the seconds hand shaft 941, the eccentric shaft member 532, and the transmission wheel shaft 551 of the transmission wheel 55 are supported by the main plate 11 and the train wheel bridge 14. For this reason, a reception member can be reduced as compared to a case in which the seconds hand shaft 941, the eccentric shaft member 532, and the transmission wheel shaft 551 of the transmission wheel 55 are each supported by a different reception member, and thus a thickness of the watch 1 can be reduced.

First Barrel Complete and Second Barrel Complete

As illustrated in FIG. 10, the first barrel complete 21 and the second barrel complete 31 are disposed side by side in a plane direction orthogonal to a shaft direction of the first barrel arbor 23 and the second barrel arbor 33.

As described above, the first barrel complete 21 is coupled to the manual winding train wheel and the automatic winding train wheel, and thus the first barrel complete 21 is an uppermost barrel complete as a drive source.

As described above, the second barrel complete 31 is coupled to the center wheel and pinion 92 and drives a hand driving mechanism of hour, minute, and seconds hands, and thus the second barrel complete 31 is a lowermost barrel complete as a drive source.

The first barrel complete 21 has a planar dimension as viewed from the shaft direction of the first barrel arbor 23, and specifically, a tooth tip circle diameter da1 is set smaller than a tooth tip circle diameter da2 of the second barrel complete 31. Further, a thickness H1 of the first barrel 22 of the first barrel complete 21 is greater than a thickness H2 of the second barrel 32 of the second barrel complete 31.

The second barrel 32 of the second barrel complete 31 meshes with a pinion of the center wheel and pinion 92 disposed in a planar center of the main plate 11, and is set to a dimension to a diameter as large as possible, i.e., a dimension close to a radius of the main plate 11 in a range from the planar center of the main plate 11 to an outer circumference, as illustrated in FIG. 4, so as to increase the number of turns of the second mainspring 30 as much as possible.

Further, the second barrel 32 has a large planar size, and is thus set such that a thickness can be reduced and the windup display train wheel 71 and the like can be disposed in an overlapping manner in the plan view.

The first barrel 22 of the first barrel complete 21 has a planar dimension set to be approximately as small as about 50 to 70% of the second barrel 32, and can thus be disposed in the space between the second barrel complete 31 and the manual windup mechanism 40, as illustrated in FIG. 4, and the space is effectively utilized.

Here, the dimensions of the first barrel complete 21 and the second barrel complete 31 can be set as appropriate. For example, the first barrel complete 21 has the tooth tip circle diameter da1 of 8.8 mm, and the second barrel complete 31 has the tooth tip circle diameter da2 of 16.0 mm. Thus, the tooth tip circle diameter da2 of the second barrel complete 31 is a dimension about 1.5 to 2.0 times greater than the tooth tip circle diameter da1 of the first barrel complete 21. Note that an inner diameter of the first barrel 22 in which the first mainspring 20 is accommodated is 7.8 mm, for example, and an inner diameter of the second barrel 32 in which the second mainspring 30 is accommodated is 15.0 mm, for example.

Further, the thickness H1 of the first barrel 22 is 1.9 mm, for example, and the thickness H2 of the second barrel 32 is 1.6 mm, for example. Thus, the thickness H1 of the first barrel 22 is a dimension about 1.1 to 1.5 times greater than the thickness H2 of the second barrel 32.

The first mainspring 20 of the first barrel complete 21 is wound up by the manual windup mechanism 40 and the automatic windup mechanism 50. The second mainspring 30 of the second barrel complete 31 is wound up with force that unwinds the first mainspring 20.

Here, the force that unwinds the first mainspring 20 is transmitted from the first barrel complete 21 to the second ratchet wheel 34 of the second barrel complete 31 via the barrel intermediate wheel 27. When a ratio of the number of teeth of a transmission path between the first barrel complete 21 and the second barrel complete 31 is 1, it is preferable that windup torque of the first mainspring 20 is greater than windup torque of the second mainspring 30, i.e., windup torque of the first barrel complete 21 is greater than windup torque of the second barrel complete 31.

In the present exemplary embodiment, the first mainspring 20 has a plate thickness of 0.098 mm, has a width dimension along a thickness direction of the first barrel 22 (shaft direction of the first barrel arbor 23) of 1.25 mm, and has a maximum value of torque of about 62 gcm (6.08 mNm).

The second mainspring 30 has a plate thickness of 0.114 mm, has a width dimension along a thickness direction of the second barrel 32 (shaft direction of the second barrel arbor 33) of 0.88 mm, and has a maximum value of torque of about 56 gcm (5.49 mNm).

Thus, the windup torque of the first mainspring 20 is set to be approximately 10% higher than the windup torque of the second mainspring 30.

The watch 1 according to the present exemplary embodiment is an electronically controlled mechanical watch using a mechanism for adjusting rotation of the rotor 81 of the generator 80 as a speed governing mechanism of the display train wheel 90. Then, the first mainspring 20 and the second mainspring 30 are used in a range in which the torque is maintained at or above a constant level. For example, for the first mainspring 20, the number of turns when mainspring torque is maximum is about 6.5 turns, and the number of turns until the mainspring torque is reduced to a constant level, for example, equal to or less than 44 gcm is about 4.5 turns, which takes about 35 hours in terms of a duration of the watch 1.

Further, for the second mainspring 30, the number of turns when mainspring torque is maximum is about 15 turns, and the number of turns until the mainspring torque is reduced to a constant level, for example, equal to or less than 42 gcm is about 10.5 turns, which takes about 85 hours in terms of a duration of the watch 1.

Note that the number of turns until the torque of each of the mainsprings 20 and 30 is reduced to or below the constant level described above can be determined in advance by experiment or the like, and the number of rotations of the second barrel complete 31 until this number of turns is reached can also be determined in advance. Thus, the power reserve hand 5 has a duration set to zero when the torque of each of the mainsprings 20 and 30 is reduced to or below the constant level described above, and the power reserve train wheel 70 is provided with a stop mechanism, such as a cam, for engaging with the toothed gear of the second barrel complete 31 when the duration is zero, and stopping the rotation of the second barrel complete 31.

Note that the mechanism for stopping the rotation of the second barrel complete 31, i.e., the first barrel complete 21 is not limited to a mechanical mechanism using the cam and the like, and a control mechanism by a control IC that applies a short brake to the rotor 81 of the generator 80 and stops the rotor 80 via the display train wheel 90 may be used.

Since the watch 1 includes the automatic windup mechanism 50, it is necessary to provide a slip mechanism in order to prevent mainspring breakage due to excessive winding up. Since the second mainspring 30 is wound up by the first mainspring 20, providing the slip mechanism in the first mainspring 20 reduces windup efficiency of the second mainspring 30.

Thus, the first mainspring 20 is fixed with an outer circumferential end of the first mainspring 20 engaging with a notch provided in an inner circumferential surface of the first barrel 22, without using the slip mechanism. Further, the second mainspring 30 includes the slip mechanism and is fixed to an inner circumferential surface of the second barrel 32 by a slipping attachment 35.

The first barrel complete 21 coupled to the manual windup mechanism 40 and the automatic windup mechanism 50 has a small diameter, and thus the windup torque tends to increase. The present exemplary embodiment has a configuration different from a known configuration in which the transmission wheel shaft 551 of the transmission wheel 55 serving as a windup wheel that winds up the first barrel complete 21 does not overlap the first barrel 22 in the plan view. In this way, the diameter of the first ratchet wheel 24 that meshes with the transmission wheel 55 can be made as large as possible, and the windup torque can be suppressed. In other words, in the present exemplary embodiment, a tooth tip circle diameter da3 of the first ratchet wheel 24 is set greater than the tooth tip circle diameter da1 of the first barrel 21.

Advantageous Effects of Exemplary Embodiment

According to the present exemplary embodiment, the following advantageous effects can be produced.

The watch 1 according to the present exemplary embodiment includes the first barrel complete 21, and the second barrel complete 31 to which rotation of the first barrel complete 21 is transmitted. Thus, a duration when the first mainspring 20 and the second mainspring 30 are fully wound up can be extended.

Further, in the present exemplary embodiment, since the first barrel complete 21 and the second barrel complete 31 are disposed side by side in a planar direction orthogonal to the shaft direction of the first barrel arbor 23, a thickness of the watch 1 can be reduced as compared to a case in which the first barrel complete 21 and the second barrel complete 31 are disposed in an overlapping manner in the shaft direction.

Furthermore, since a tooth tip circle diameter of the first barrel complete 21 is smaller than a tooth tip circle diameter of the second barrel complete 31 and a thickness of the first barrel 22 is greater than a thickness of the second barrel 32, an arrangement space of the first barrel complete 21 and the second barrel complete 31 can be effectively utilized in the movement 10, and an empty space can be reduced.

Therefore, the watch 1 having a long duration can be provided while suppressing an increase in planar size and thickness of the watch 1. In other words, the second barrel complete 31 coupled to the center wheel and pinion 92 is disposed in a range from the planar center position of the main plate 11 in which the center wheel and pinion 92 is disposed to the outer circumference of the main plate 11, and thus the number of turns of the second mainspring 30 can also be increased, and a duration of the watch 1 can also be extended. Furthermore, since the second barrel 32 is set thinner than the first barrel 22, the windup display train wheel 71 and the like can also be disposed in an overlapping manner in the plan view, and a space can be effectively utilized.

Further, since a thickness of the first barrel complete 21 coupled to the manual windup mechanism 40 and the automatic windup mechanism 50 is greater than a thickness of the second barrel complete 31, a width dimension of the first mainspring 20 can also be increased. Thus, a plate thickness of the first mainspring 20 can be reduced, and, even when a diameter of the first barrel 22 is small, the number of turns can be secured and a torque balance can be established.

Since windup torque of the first barrel complete 21 is greater than windup torque of the second barrel complete 31, the second barrel complete 31 can be stably wound up by the first barrel complete 21.

The first mainspring 20 is fixed with one end of the first mainspring 20 engaging with the notch provided in the inner circumferential surface of the first barrel 22, and the second mainspring 30 is fixed to the inner circumferential surface of the second barrel 32 by the slipping attachment 35. Thus, torque management when each of the mainsprings 20 and 30 is fully wound up can be facilitated, and stable winding up can be achieved.

In the transmission wheel 55 that includes the automatic windup mechanism 50 for winding up the first mainspring 20 and serves as a windup wheel of the automatic windup mechanism 50, the transmission wheel shaft 551 does not overlap the first barrel 22 in the plan view, and thus the watch 1 can be reduced in size as compared to a structure in which the shaft of the windup wheel overlaps the first barrel 22 in the plan view. Further, since a thickness of the first barrel 22 can also be set relatively greater, a width dimension of the first mainspring 20 can be further increased.

Since a tooth tip circle diameter of the first ratchet wheel 24 fixed to the first barrel arbor 23 is set greater than a tooth tip circle diameter of the first barrel complete 21, windup torque of the first barrel complete 21 having a small diameter can be reduced.

In the present exemplary embodiment, when the watch 1 is divided into two regions of the first region including the hour mark 3B indicating six o'clock and the second region including the hour mark 3B indicating 12 o'clock by the line segment connecting the hour marks 3B indicating three o'clock and nine o'clock of the dial 3 in the plan view, the first barrel complete 21 and the second barrel complete 31 are disposed in the second region. Thus, the first barrel complete 21 and the second barrel complete 31 do not interfere with the generator 80 and the like disposed in the first region, and thus a layout of each of the components can be facilitated in the movement 10.

Further, since the first barrel complete 21 having a small diameter and the second barrel complete 31 having a large diameter are disposed in the second region, the second region can be effectively utilized.

Furthermore, in the movement 10, the mainspring remaining amount display mechanism, the hand driving mechanism, the speed governing mechanism, the power generation mechanism, and the like can be disposed in the remaining empty space in which the first barrel complete 21 and the second barrel complete 31 are disposed, and thus the space can be effectively utilized.

Modification Example

Note that the present disclosure is not limited to each of the exemplary embodiments described above, and variations, modifications, and the like within the scope in which the object of the present disclosure can be achieved are included in the present disclosure.

In the exemplary embodiment described above, the watch 1 is configured as an electronically controlled mechanical watch including the generator 80 and the display train wheel 90, which is not limited thereto. For example, the watch may be configured as a mechanical watch including a general speed governing mechanism, such as an escape wheel and a pallet fork.

In the exemplary embodiment described above, the windup torque of the first barrel complete 21 is greater than the windup torque of the second barrel complete 31, but may be set to the same value or may be set to a slightly smaller value.

In the exemplary embodiment described above, the first mainspring 20 engages with and is fixed to the inner circumferential surface of the first barrel 22 and the second mainspring 30 is fixed by using the slipping attachment, but the first mainspring 20 may be fixed by using the slipping attachment, and the second mainspring 30 may be fixed to the inner circumferential surface of the second barrel 32.

In the exemplary embodiment described above, the tooth tip circle diameter of the first ratchet wheel 24 is greater than the tooth tip circle diameter of the first barrel complete 21, but the diameters may be set to the same dimension, or the diameter of the first ratchet wheel 24 may be slightly smaller than the diameter of the first barrel complete 21.

Summary of Present Disclosure

A watch according to the present disclosure includes a first barrel complete including a first barrel arbor, a first mainspring, and a first barrel, and a second barrel complete that includes a second barrel arbor, a second mainspring, and a second barrel, is disposed side by side in a planar direction orthogonal to a shaft direction of the first barrel arbor, and receives transmission of rotation of the first barrel complete, where a tooth tip circle diameter of the first barrel complete is smaller than a tooth tip circle diameter of the second barrel complete, and a thickness of the first barrel is greater than a thickness of the second barrel.

In this way, a duration can be extended while suppressing a planar size and a thickness of the watch 1. Particularly, when the two barrel completes are disposed in a planar circular movement, an arrangement space can be effectively utilized, and an empty space can be reduced.

Further, since a thickness of the first barrel complete coupled to a manual windup mechanism and an automatic windup mechanism is greater than a thickness of the second barrel complete, a width dimension of the first mainspring can also be increased. Thus, a plate thickness of the first mainspring can be reduced, and, even when a diameter of the first barrel is small, the number of turns can be secured and a torque balance can be established.

In the watch according to the present disclosure, windup torque of the first barrel complete is greater than windup torque of the second barrel complete.

In this way, the second barrel complete can be stably wound up by the first barrel complete.

In the watch according to the present disclosure, the first mainspring is fixed with one end of the first mainspring engaging with a notch provided in an inner circumferential surface of the first barrel, and the second mainspring is fixed to an inner circumferential surface of the second barrel by a slipping attachment.

In this way, torque management when each of the mainsprings is fully wound up can be facilitated, and stable winding up can be achieved.

The watch according to the present disclosure includes an automatic windup mechanism for winding up the first mainspring, where a first ratchet wheel is fixed to the first barrel arbor, and the automatic windup mechanism includes a windup wheel configured to mesh with the first ratchet wheel, and a shaft of the windup wheel does not overlap the first barrel in plan view as viewed from a shaft direction of the first barrel arbor.

In this way, the watch can be reduced in size as compared to a structure in which the shaft of the windup wheel overlaps the first barrel in the plan view. Further, since a thickness of the first barrel can also be set relatively greater, a width dimension of the first mainspring can be further increased.

In the watch according to the present disclosure, a first ratchet wheel is fixed to the first barrel arbor, and a tooth tip circle diameter of the first ratchet wheel is greater than a tooth tip circle diameter of the first barrel complete.

In this way, windup torque of the first barrel complete 21 having a small diameter can be reduced.

The watch according to the present disclosure includes a dial including a plurality of graduations being written, where, when the watch is divided into two regions by a line segment connecting the graduations indicating three o'clock and nine o'clock of the dial in plan view as viewed from a direction orthogonal to the dial, the first barrel complete and the second barrel complete are disposed in one of the regions, and a speed governing mechanism for governing a speed of a train wheel driven by the first barrel complete and the second barrel complete is disposed in the other region.

In this way, the first barrel complete and the second barrel complete disposed in one of the regions do not interfere with the speed governing mechanism disposed in the other region, and thus a layout of each of the components can be facilitated in the movement. Further, since the first barrel complete having a small diameter and the second barrel complete having a large diameter are disposed in one of the regions, a space in one of the regions can be effectively utilized.

What is claimed is:

1. A watch comprising:

a first barrel complete including a first barrel arbor, a first mainspring, and a first barrel; and a second barrel complete that includes a second barrel arbor, a second mainspring, and a second barrel, and is disposed side by side in a planar direction orthogonal to a shaft direction of the first barrel arbor so that rotation of the first barrel complete is transmitted to the second barrel, wherein a tooth tip circle diameter of the second barrel complete is 1.5 to 2.0 times greater than a tooth tip circle diameter of the first barrel complete, and a thickness of the first barrel is greater than a thickness of the second barrel.

2. The watch according to claim 1, wherein windup torque of the first barrel complete is greater than windup torque of the second barrel complete.

3. The watch according to claim 1, wherein the first mainspring is fixed with one end of the first mainspring engaging with a notch formed in an inner circumferential surface of the first barrel, and the second mainspring is fixed to an inner circumferential surface of the second barrel by a slipping attachment.

4. The watch according to claim 1 comprising:

an automatic windup mechanism for winding up the first mainspring, wherein a first ratchet wheel is fixed to the first barrel arbor, and the automatic windup mechanism includes a windup wheel configured to mesh with the first ratchet wheel, and a shaft of the windup wheel does not overlap the first barrel in plan view as viewed from a shaft direction of the first barrel arbor.

5. The watch according to claim 1, wherein a first ratchet wheel is fixed to the first barrel arbor, and a tooth tip circle diameter of the first ratchet wheel is greater than a tooth tip circle diameter of the first barrel complete.

6. The watch according to claim 1 comprising:

a dial including a plurality of graduations provided thereon, wherein, when the watch is divided into two regions by a line segment connecting the graduations indicating three o'clock and nine o'clock of the dial in plan view as viewed from a direction orthogonal to the dial, the first barrel complete and the second barrel complete are disposed in one of the regions, and a speed governing mechanism for governing a speed of a train wheel driven by the first barrel complete and the second barrel complete is disposed in the other region.

* * * * *